United States Patent [19]

Skuran

[11] 4,250,678

[45] Feb. 17, 1981

[54] MOUNTING FOR INSULATED PANEL

[75] Inventor: Victor Skuran, Chicago, Ill.

[73] Assignee: Transco, Inc., Ill.

[21] Appl. No.: 34,253

[22] Filed: Apr. 30, 1979

[51] Int. Cl.[3] ..... E04B 1/60; E04B 2/82

[52] U.S. Cl. ..... 52/478; 52/489; 52/509

[58] Field of Search ..... 52/478, 410, 489, 521, 52/537, 541, 509, 276; 403/405

[56] References Cited

U.S. PATENT DOCUMENTS 1,659,539 2/1928 Judson ..... 52/489

FOREIGN PATENT DOCUMENTS 193546 12/1964 Sweden ..... 52/478

*Primary Examiner*—James L. Ridgill, Jr.

*Attorney, Agent, or Firm*—Edward C. Threedy

[57] ABSTRACT

A mounting for a prefabricated insulated panel comprising an outer metallic covering upon which are mounted batts of insulated material. A Z-shaped connector embraces an exposed edge of the batts of insulating material and is adapted to provide a mounting connection between the outer covering and a combination internal spacer and mounting connector extending through the insulating material for attaching the panel to a structural support.

3 Claims, 5 Drawing Figures

MOUNTING FOR INSULATED PANEL

SUMMARY OF THE INVENTION

An object of the present invention is to provide a mounting for an insulated panel for attachment to a supporting structure. The insulated panel is prefabricated and consists of an outer metallic covering as well as a plurality of batts of insulating material.

It is preferred in prefabricating an insulating panel to utilize a plurality of batts of insulating material rather than a single thick burdensome batt. The reason for this is that the insulated material is normally constructed of fiberglass, and is susceptible to tears, rips, and ruptures which, if they occur at the time of installation, require the replacement of the whole panel. The present invention would permit the removal of only that batt of insulating material which was ripped or ruptured, with the replacement being capable of being accomplished on the job.

The present invention also provides a means of mounting the batts of insulation in a ship-lap manner. The present invention also provides protection to certain longitudinal edges of the batt of insulating material during the application of the prefabricated panel onto a supporting structure.

The invention also provides for a minimum contact of metallic parts, thereby reducing the degree of heat transfer within the prefabricated panel.

GENERAL DESCRIPTION

Figure 1:
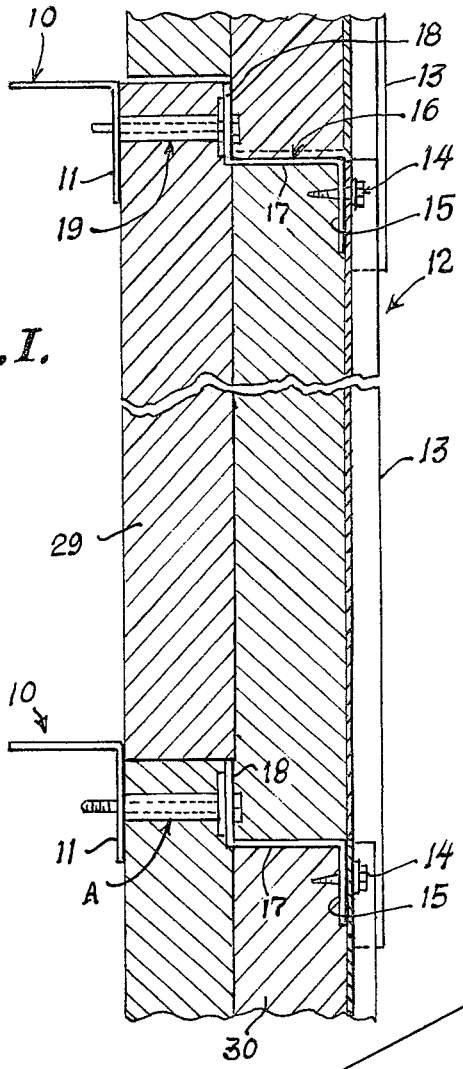
Figure 5:
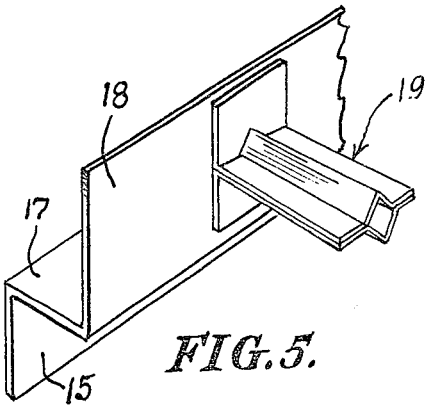
Figure 2:
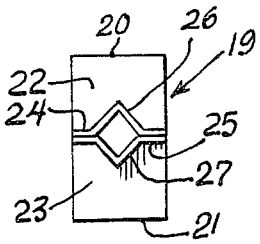
Figure 3:
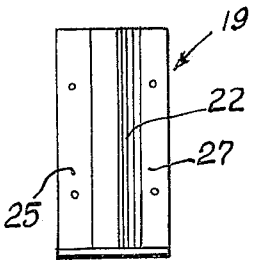
Figure 4:
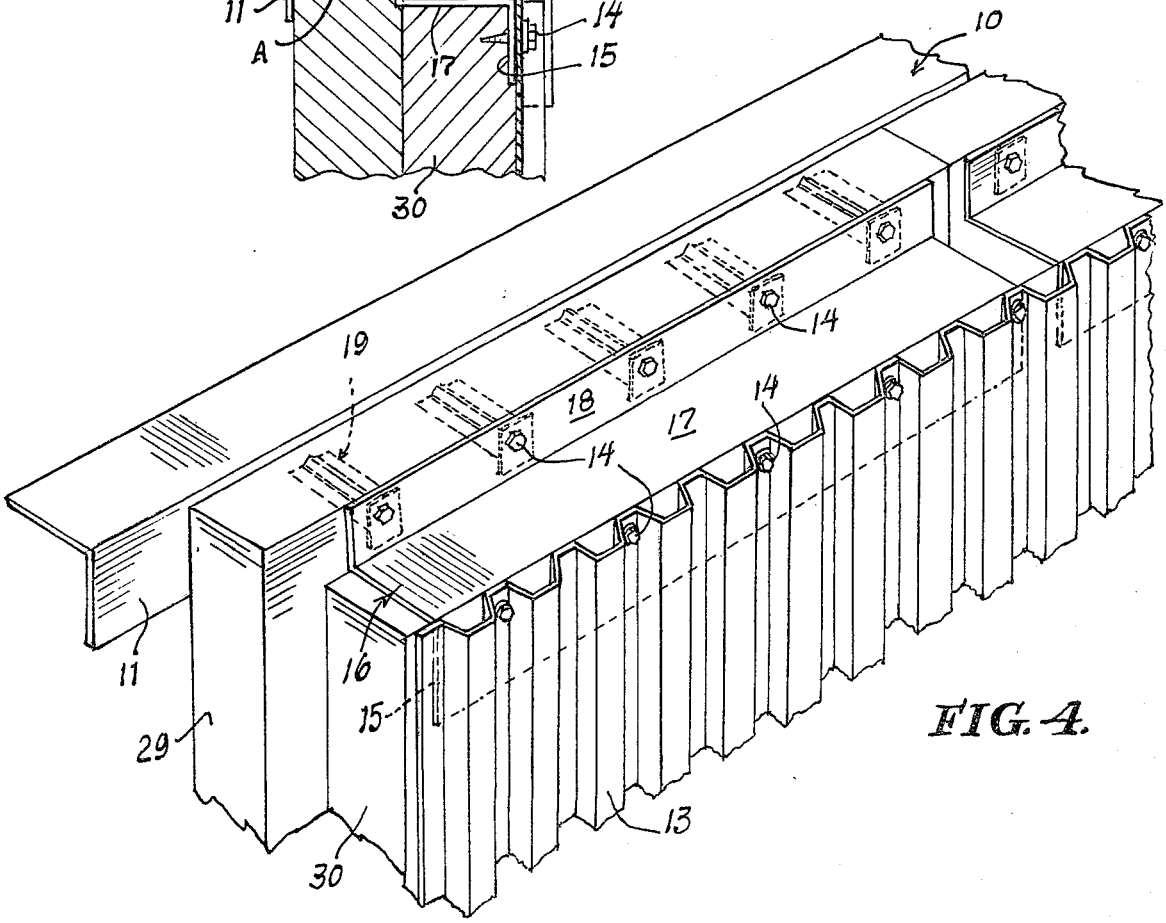

The objects of this invention are best achieved by the construction of a mounting for an insulated panel, as shown in the accompanying drawings, which illustrate the preferred method of construction, and in which FIG. 1 is a side elevational sectional view of the mounting for an insulated panel, FIG. 2 is a top plan view of the spacer member utilized in the mounting, FIG. 3 is a side elevational view of the spacer member, FIG. 4 is a fragmentary perspective view of one end of the insulated panel and its mounting therefor, and FIG. 5 is a fragmentary perspective view of the support structure for the prefabricated insulated panel.

As viewed in FIGS. 1 and 4, there is illustrated a supporting structure 10, which provides a vertical mounting surface 11.

A prefabricated panel 12 is illustrated, consisting of an outer metallic covering 13, which may be corrugated, as shown in FIG. 4. This covering 13, by suitable connectors 14, is attached to a horizontally extending flange 15 of an elongated panel mounting member 16.

This panel mounting member 16 is Z-shaped, and as such provides the horizontally extending vertical flange 15, which projects from one edge of the medial portion of the body 17 of the member 16. This medial portion of the body 17 terminates at its opposite longitudinal edge in a second flange 18, which extends in an opposite vertical direction from that of flange 15, as shown.

Extending in a horizontal plane from the rear wall surface of the second vertical flange 18 is a spacer 19.

As shown in FIGS. 2 and 3, this spacer 19 is constructed from two L-shaped elements 20 and 21. Each of the L-shaped elements 20 and 21 provides a base 22 and 23, respectively, and have their long leg portions 24 and 25 formed to provide oppositely facing V-sections 26 and 27, respectively. The long legged portions 24 and 25 are then connected by spot welding and the like so as to form an integral spacer, as shown.

The bases 22 and 23 of the spacer 19 are in turn welded to the rear wall of the second flange 18 and communicate with an opening formed therein so that a connector 28 may pass therethrough for attaching the spacer 19 to the supporting structure 10.

Carried by the rear wall surface of the covering 13 are batts of insulating material 29 and 30. These may be connected to the covering 13 in any manner such as is well known in the art. As shown in FIGS. 1 and 4, the batts 29 and 30 are caused to be vertically offset corresponding in degree to the lengths of the oppositely extending flanges 15 and 18 of the panel mounting member 16. By this arrangement subsequent panels may be mounted in a ship-lap fashion upon the supports 10 so as to provide an insulated panel.

The medial body portion 17 of the panel mounting member 16 cooperates with the spacer 19 to resist compression of the insulating material in the batts 29 and 30 during erection of the panel onto the supporting structure 10. The configuration of the panel mounting member 16 in a substantial Z-shaped form cooperates to resist compression of the insulating material by presenting the flanges 15 and 18 in a plane transverse to the normal plane of the spacer 19 while being parallel to the mounting surface 11 of the structural support 10 and the normal plane of the metallic covering 13. Through the use of the hollow spacer 19 the panels 12 may be readily attached and/or removed from the structural support 10 without destruction of the insulating material.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A prefabricated insulated panel and mounting therefor whereby the panel is attached to a supporting structure comprising:

(a) an elongated Z-shaped panel mounting member, one leg of which is adapted to extend in spaced parallel relation to the supporting structure, (b) a spacer mounted on said one leg of said member and extending in the direction of, and bearing against, the supporting structure, (c) a first batt of insulating material mounted on said spacer so as to extend from between the supporting structure and said one leg of said Z-shaped panel mounting member, (d) a connector carried by said spacer connecting the same and said first batt of insulating material to the supporting structure with said panel mounting member in spaced relation thereto, (e) a cover connected to the other of said legs of said Z-shaped panel mounting member and extending in a spaced parallel relation to said first batt of insulating material and, (f) a second batt of insulating material mounted on the rear surface of said cover and behind said other of said legs of said panel mounting member and having a thickness equal to the length of the medial portion of said panel mounting member and having one edge abutting thereagainst so as to extend between said cover and said first batt of insulating material.

2. A prefabricated insulated panel and mounting as defined by claim 1 wherein said spacer comprises a rigid elongated hollow diamond-shaped member mounted on said one leg of said panel mounting member and having open communication with an aperture formed therethrough, said connector being freely journalled in said hollow member so as to connect said spacer to the supporting structure.

3. A prefabricated insulated panel and mounting as defined by claim 1 wherein each of said batts of insulating material are related to said panel mounting member whereby certain of their edges are offset vertically with respect to each other.

* * * * *